United States Patent [19]

Nellessen, Jr.

[11] Patent Number: 4,841,894

[45] Date of Patent: Jun. 27, 1989

[54] HULL CLEANER

[76] Inventor: Peter Nellessen, Jr., 7825 Normandy St., Miramar, Fla. 33023

[21] Appl. No.: 163,253

[22] Filed: Mar. 2, 1988

[51] Int. Cl.[4] ..... B63B 59/00

[52] U.S. Cl. ..... 114/222; 15/DIG. 2

[58] Field of Search ..... 114/222; 15/DIG. 2

[56] References Cited

U.S. PATENT DOCUMENTS

| | | | |
|---|---|---|---|
| 3,227,124 | 1/1966 | Campbell | 114/222 |
| 4,043,286 | 8/1977 | Doty | 114/222 |
| 4,046,095 | 9/1977 | Fike | 114/222 |
| 4,401,048 | 8/1983 | Rogers | 114/222 |

*Primary Examiner*—Joseph F. Peters, Jr.
*Assistant Examiner*—Jesus D. Sotelo
*Attorney, Agent, or Firm*—Richard C. Litman

[57] ABSTRACT

A trolley to convey brushes for cleaning a stationary hull is drawn along the bottom and sides of the hull. Brushes are supported by variable buoyancy chambers to make the biasing of the brushes against the hull also in turn variable. The trolley can be supported and stored in a dock or alternatively supported by a floating platform. There is an electrical motor drive for a chain which pulls the trolley. A diesel prime mover may be used in the floating platform to generate power for the electric motor chain drive and for the submersible motors.

14 Claims, 4 Drawing Sheets

HULL CLEANER

FIELD OF THE INVENTION

Marine growths accumulate rapidly and are present on all boat hulls including those coated with anti-fouling paints. The presence of marine growths on boat bottoms causes increased fuel usage, reduced speed, and can lead to poor boat performance. These growths are both soft and hard and occur in fresh and salt water. The hull cleaner is designed to clean marine growths from the bottom of a commercial or pleasure boat without removing the boat from the water and without use of divers. It will clean both power and sailboat hulls.

SUMMARY OF THE INVENTION

In two embodiments a trolley conveying initially horizontal and vertical brushes below a hull is drawn by motor driven chain in a dock supported apparatus in one of the embodiments and in floating platform means that is transportable to the hull in the other embodiment. The hull does not have to be taken out of the water. The brushes are each supported by a variable buoyancy chamber and thus the biasing of the brushing against the hull during cleaning is also readily variable.

RELATED REFERENCES

U.S. Pat. No. 3,010,420 to J. C. Glynn is drawn to a buoyant bottom brush for scrubbing hulls that is not suitable for putting on a trolley conveyance for traveling longitudinally along the hulls and certainly is not suitable for use of a pair of brushes mounted on such a trolley.

U.S. Pat. No. 1,471,935 to H. Arentz is drawn to a brush that has no special adaptations to follow the contours of the hull which is designed to brush.

U.S. Pat. No. 4,043,286 to F. L. Doty is drawn to a scrubbing system the boat rather than a trolley is drawn by a winch through the scrub brush system. There are horizontal brushes but they are not held by a buoyant chamber but are biased by the free floating frame that holds the brushes and through which the boat is drawn. Thus there is no means by which the buoyancy can be made variable.

U.S. Pat. No. 4,401,048 to R. C. Rogers is drawn to a trolley-like brushing system but does not have biasing of the brushes against the hull by variable buoyancy.

U.S. Pat. No. 3,800,732 to D. A. Hill is a brush system pushed by a conveyance along the hull. The brushes are biased bydraulically and are spun parallel to the hull when they are horizontal brushes.

U.S. Pat. No. 3,946,692 to C. Sierra, et al. is drawn to a brush system that is biased against the surface to be cleaned by a turbine or propeller system.

U.S. Pat. No. 3,951,092 to B. C. van den Broek is drawn to an articulatedly supported vehicle movable about a ship's hull for cleansing purposes.

U.S. Pat. No. 4,046,095 to D. G. Fike is drawn to a floating platform through which a hull to be clean passes. Buoyancy of brushes and support structure must be mitigated by tensioning cables.

DETAILED DESCRIPTION OF THE PREFERRED EMBODIMENTS

Figure 1:
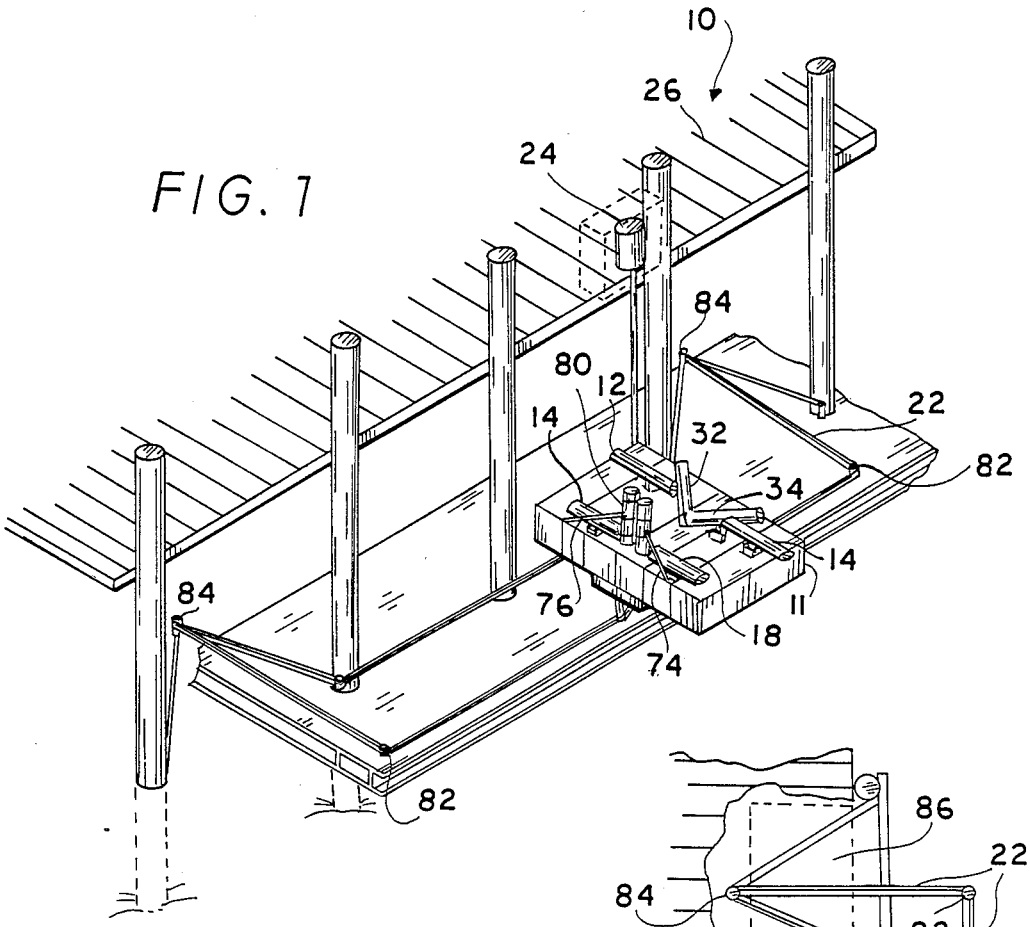
FIG. 1 is a perspective view of the one embodiment of the hull cleaner for use with a dock.
Figure 5:
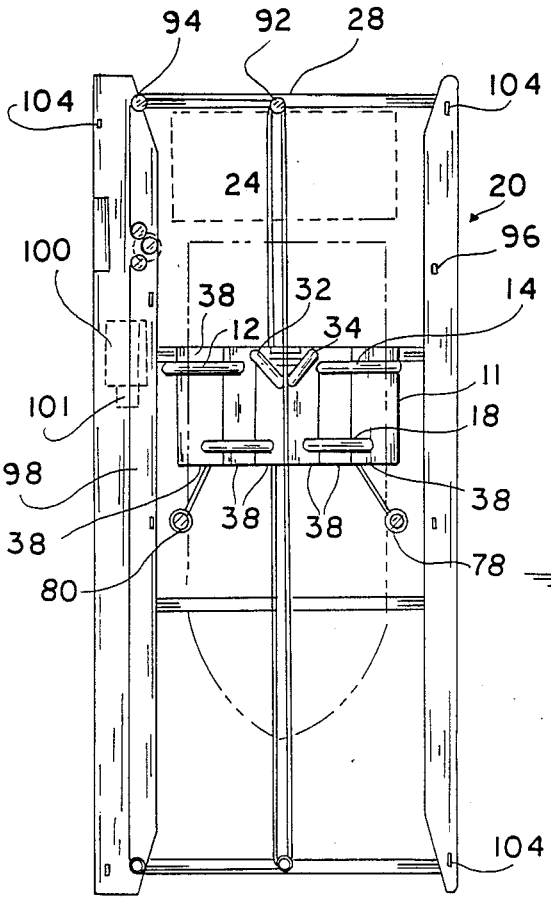
FIG. 5 is a plan view of the cleaner on a movable platform.
Figure 6:
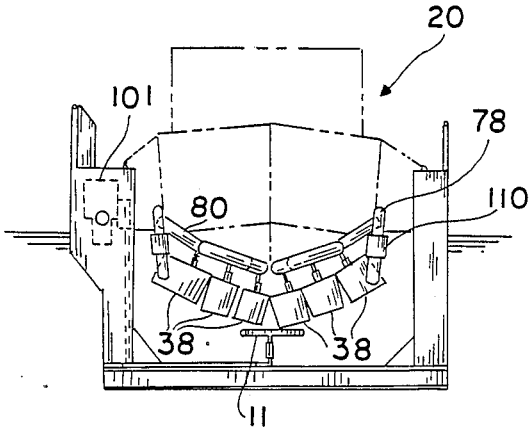
FIG. 6 is a view from an end of the platform of the brushes and trolley.

Referring to FIG. 1 and FIG. 5, trolley 11 is shown in two embodiments shown generally at 10 and 20. The trolley 11 is drawn by a chain 22 driven by chain drive motor 24 anchored to mooring dock 26 in FIG. 1 and assembly 28 with portions 96 and 98 in FIG. 5.

Figure 2:
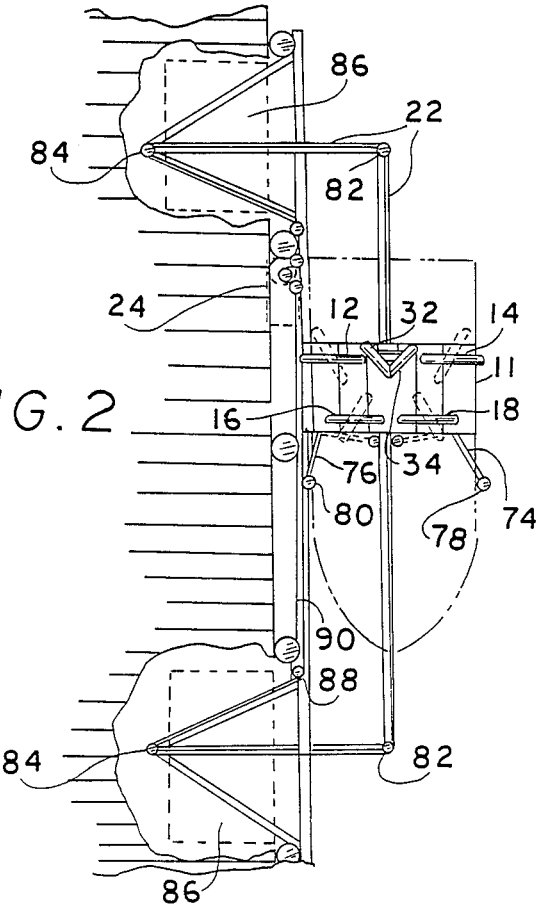
FIG. 2 is a plan view of the dock and trolley of the cleaner.
Figure 3:
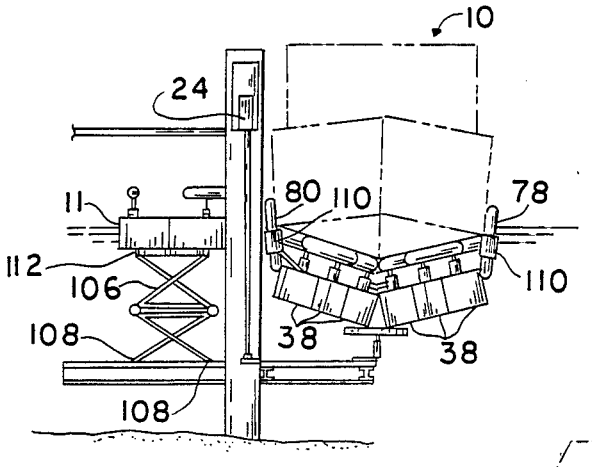
FIG. 3 is a view parallel to the dock.
Figure 4:
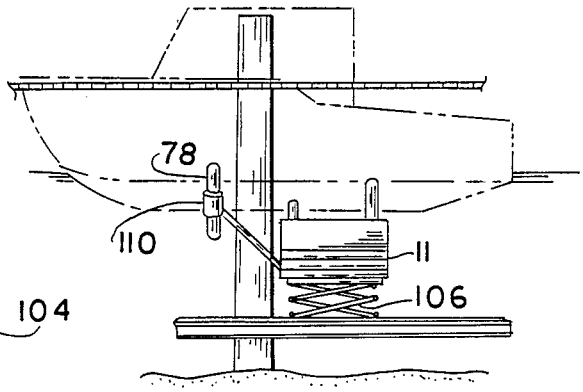
FIG. 4 is a view toward the dock of the trolley scrubbing a hull.

Trolley 11 conveys pivotable brushes 12, 14, 16 and 18 and stationary brushes 32 and 34 which are horizontal when not in use but potentially active before contact with a hull 30 shown in phantom in FIG. 2 and FIG. 5 in use and in contact with the brushes 12, 14, 16, 18, 32 and 34.

Figure 11:
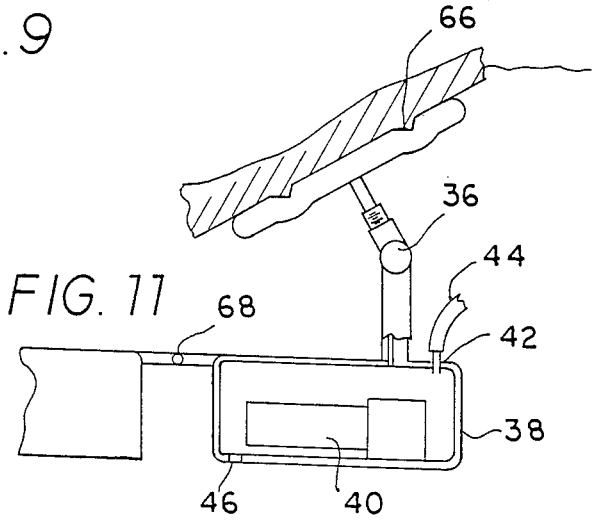
FIG. 11 is a view of the float chamber with a submersible motor driving a horizontal brush pivoted about a universal joint to an oblique angle.

The horizontal brushes 12, 14, 16 and 18 are supported on a universal joint 36 driven by individual submersible motors 40 and shown in detail in FIG. 11 which is in turn supported by a buoyant chamber 38 holding the submersible motor 40. Separate submersible motors 40 drive the horizontal brushes 12, 14, 16 and 18 each through universal joint 36. The buoyant chamber 38 has its air content controlled by a source of pressure (not shown) through an aperture 42 by a conduit 44. There is an opening in the bottom of chamber 38 at 46 through which the water level in and of course consequently the biasing buoyancy of the chamber 38 may be varied.

Figure 7:
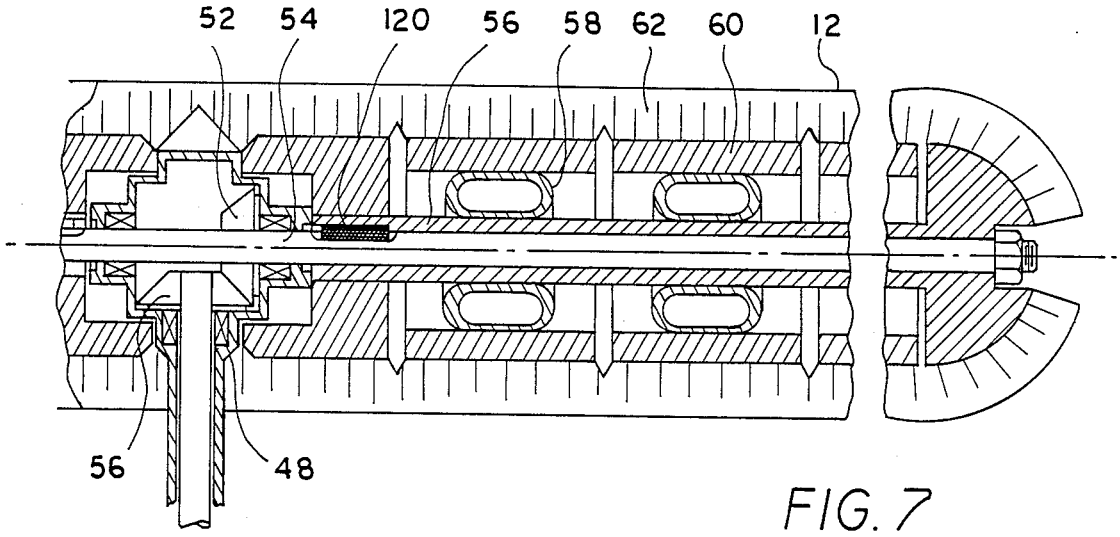
FIG. 7 is a cut-away view of one brush and its drive head.
Figure 8:
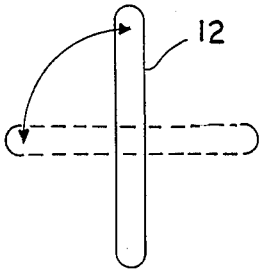
FIG. 8 is a horizontal pivotable brush in top view.
Figure 9:
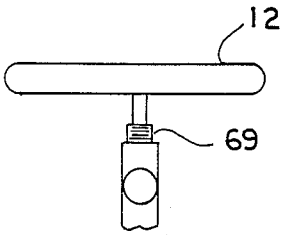
FIG. 9 is a front view of the brush of FIG. 8 with a torsion spring to bias the brush in its pivotability.
Figure 10:
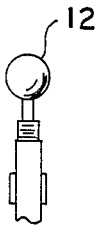
FIG. 10 is a side axial view of the brush showing its rotation for scrubbing.
Figure 12:
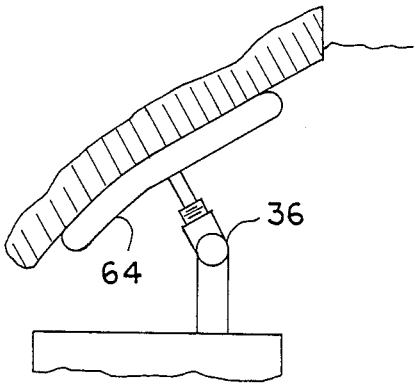
FIG. 12 shows how the resiliency of the brush of FIG. 7 serves different contours.

A hinge 68 couples the chambers 38 along a line normal to the keel of the boat. The brushes 12, 14, 16, 18, 32 and 34 are cylindrical and in FIG. 7 are shown to be driven at drive head 48 with bevel gears 50 and 52. The brushes can also be driven by a chain, belt or other suitable means (not shown). Shaft 54 is coupled to bevel gear 52 and shaft 54 is splined to sleeve 56. Flexible toroidal elements 58 are contiguous with sleeve 56 and a hub 60. Bristles 62 are radially held by hub 60 with all of the aforesaid brush features creating a brush that can accommodate itself to irregularities in the hull surface as at 66 in FIG. 11 and contours for dynamic fluid as at concave surface portion 64 in FIG. 12.

Figure 14:
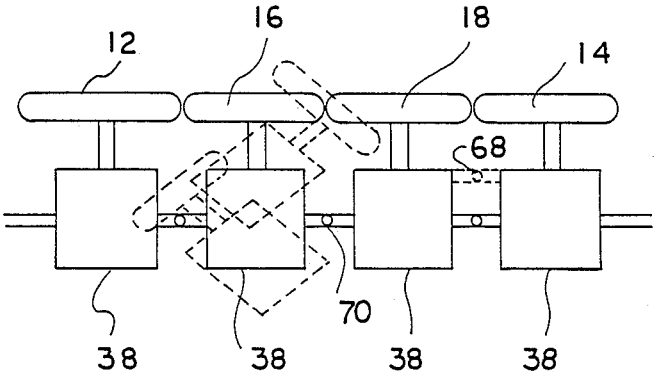
FIG. 14 shows how the float chamber may be pivoted with respect to each to conform to the overall contour of a hull.
Figure 13:
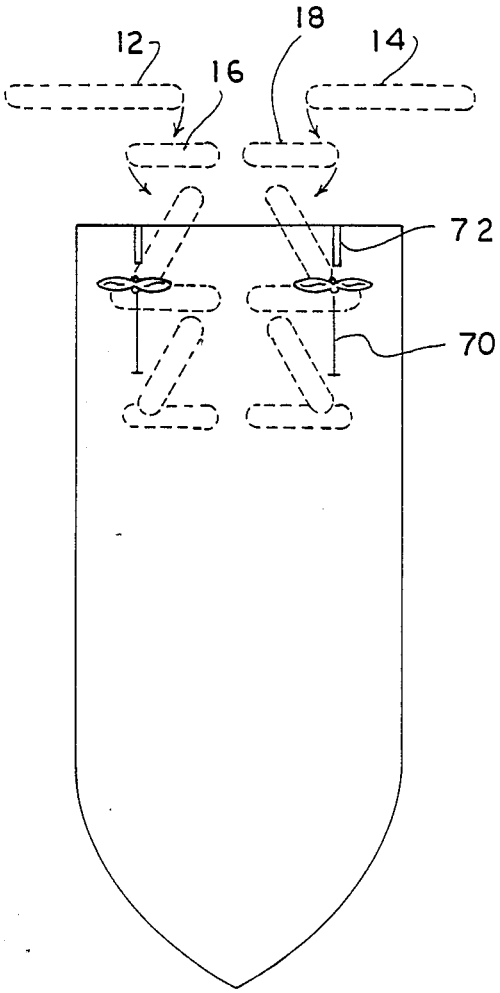
FIG. 13 shows how the horizontal brushes may also pivot about vertical axis to avoid obstructions on the hull surface.

The horizontal brushes 12, 14, 15 and 18 are pivotally equipped with torsion springs at 69 about the lower portion of their drive heads 48. This torsional biasing will allow pivoting of the brushes as shown in FIG. 13 about appendages such as the propeller shaft and rudder assemblies 70 and 72 respectively. The horizontal brushes are sub-divided into pairs, inner and outer. The outer pair are in line on either side of a hull being cleaned or about to be cleaned or finished cleaning and likewise the inner pair are in line also on either side of such a hull. The torsion spring pivoting allows the brushes to turn toward a longitudinal orientation with respect to the hull 30 avoiding cleaning obstructions in the direction of travel of the trolley 11. Figure 14 demonstrates how a hinge 70 connecting this time at the middle portions of the sides of the chambers 38 may be used to, in chain-like fashion, pivotally orient the brushes to accommodate different contours of the hull and hulls of different contours; and, thereby, universal joint at 36 may be eliminated. Otherwise, the hinge 68 may be used between the tops of the chambers 38 using the afore mentioned universal joints at 36. For dual propeller shafts as shown in FIG. 13 the inner and outer paired brushes turn in opposite directions about their respective drive heads 48.

There are side brushes 78 and 80 mounted on support and drive linkages 74 and 76 respectively. These brushes have pivotability and are vertical when potentially active, that is, out of contact with the hull but in position for such contact. The linkages 74 and 76 extend from the outermost buoyant chamber 38 pair and are powered by the enclosed submersible motors 40 in those chambers 38 or brushes 78 and 80 can be powered by direct coupling of the motor to each brush. These side vertical brushes 78 and 80 are structured as were the horizontal brushes 12, 14, 16, 18 and 32 as in FIG. 7. There are universal joints at 110 to accommodate the orientation of the initially vertical brushes to different contours of the hull or contours of different hulls.

FIG. 1 shows a dock 26 for mooring the boat hull 30 to be cleaned. The dock 26 may also serve to render other services to the boat, such as loading or fueling. Contained on the dock structure 26 is the chain drive motor 24 with appropriate idler sprockets 82, 84 and 88 to pull on chain 22 for in turn pulling on trolley 11. There are also storage volumes 86 in the dock and the idler sprockets 82, 84 and 88 are arranged as shown in FIG. 2 for conveying the trolley 11 under the top of the dock 26 into the storage volumes 86. Sprockets 82 allow the trolley to travel parallel to the dock 26. Sprockets 84 pull the trolley into the storage volumes 86 within dock 26. Sprockets 88 feed the chain 22 to the chain drive along the periphery 90 of the dock 26.

FIG. 5 shows a plan view of another mooring embodiment like numerals for like elements of FIG. 2 are given. The mooring embodiment is transportable to the vicinity of the hull to be cleaned. Sprockets 92 pull the trolley parallel to pontoons 96 and 98. Sprockets 94 feed the chain 22 to the drive motor 24. The drive motor 24 is driven by a generator 101 connected to generating prime mover diesel 100. There are mooring cleats at 104.

The trolley 11 as was mentioned is pulled by chain 22 which is connected fore and aft of the trolley 11. The trolley 11 may be supported on a lazy tongue scissor-type device 106 which is pulled at its bottom at 108 by the chain. There is a turning table 112 mounted on the lazy tongue scissor device below the horizontal floats for allowing the trolley to be turned toward the storage volume and for cleaning of the boat in either mooring position in the dock embodiment.

I claim:

1. In a boat cleaning apparatus that may be active and inactive the combination comprising:

at least one pair of first brushes with pivotability, which brushes are horizontal when said apparatus is potentially active;

a trolley means for conveying said at least one pair of the first brushes, wherein said trolley means is adapted to hold said at least one pair of brushes against a symmetrical boat hull and move the brushes longitudinally along said boat hull, biasing means included on said trolley means for variably forcing said at least one pair of first brushes against said hull wherein said biasing means includes chambers of variable buoyancy pressing said brushes against said hull by said variable buoyancy, and at least one pair of second brushes with pivotability that are vertical when said cleaning apparatus is inactive also conveyed by said trolley means whereby said boat hull may be cleaned without removing same from the water.

2. In a boat cleaning apparatus of claim 1 further including;

motor means for rotating said brushes; and drive means for coupling said brushes to said motor means which includes at least one universal joint for said coupling.

3. In a boat cleaning apparatus of claim 1 further including;

motor means for rotating said first and second brushes; and also including;

drive means for coupling said first and second brushes to said motor means which includes at least one universal joint.

4. In a boat cleaning apparatus of claim 3 wherein said first and second brushes have bristles and are cylindrical in shape having an axis and hubs holding the bristles.

5. In a boat cleaning apparatus of claim 4 further including;

shaft means to further couple said motor means to said first and second brushes which are adapted to be coupled to said shaft about said axis.

6. In a boat cleaning apparatus of claim 1 said combination wherein;

said chambers of variable buoyancy include submersible motor means coupled individually to said first and second brushes inside said chambers of variable buoyancy.

7. The combination of claim 6 further comprising;

a plurality of adjacent said pairs of said first brushes and biasing means supporting said brushes, hinge means holding said adjacent pairs of first brushes in a line normal to the keel of said symmetrical boat hull.

8. The combination of claim 7 wherein said buoyant chambers are of regular shape with tops and bottoms with adjacent sides and said hinge means comprises hinges attached approximately midway between said tops and said bottoms.

9. The combination of claim 7 wherein said buoyant chambers are of regular shape with tops and bottoms; said hinge means comprises hinges attached between the tops.

10. The combination of claim 6 wherein said pairs of brushes are adapted, by symmetrical arrangement, said biasing means, and said pivotability, to conform to the surface contours and cleaning obstructions of said hull; further wherein said pivotability of said brushes that are horizontal when inactive is about vertical axes and at their midportion and normal to the axis of each brush and said pivotability is resiliently torsionally biased.

11. The combination of claim 1 wherein said variably buoyant chamber includes a source of air, an aperture means for relieving air and aperture means as an inlet and outlet of water..

12. The combination of claim 11 wherein said source of air and said aperture means for relieving air are combined in one aperture and one conduit.

13. The combination of claim 1 further comprising a floating means for pulling said trolley means under said symmetrical boat hull;

said floating means comprising two parallel portions adapted to contain said hull and to support said means for pulling comprising;

tension means;

drive means to pull on said tension means; and prime mover means to power said drive means;

whereby said boat cleaning apparatus is movable from place to place.

14. The combination of claim 1 further comprising;

mooring means for tying said boat hull;

pulling means held by said mooring means for hauling said trolley means under said symmetrical boat hull;

storage means contained in said mooring means for storing said trolley means when not in use by the same, said pulling means conveying said trolley means to within said storage means, motor means to activate said pulling means, and lazy tongue scissor structure supporting said trolley means when cleaning and in storage, and said pulling means used to attach to and pull said trolley means.

* * * * *